US005261377A

United States Patent [19]

Freudenberg et al.

[11] Patent Number: 5,261,377

[45] Date of Patent: Nov. 16, 1993

[54] PROCESS FOR THE TRANSITION CORRECTION OF THE MIXTURE CONTROL OF AN INTERNAL COMBUSTION ENGINE DURING DYNAMIC TRANSITION STATES

[75] Inventors: Hellmut Freudenberg, Pentling; Wolfgang Klitta, Flörsheim; Harald Renn, Nürnberg; Anton Mayer-Dick, Fürth, all of Fed. Rep. of Germany

[73] Assignee: Siemens Aktiengesellschaft, Munich, Fed. Rep. of Germany

[21] Appl. No.: 940,884

[22] PCT Filed: Sep. 5, 1991

[86] PCT No.: PCT/EP91/01683

§ 371 Date: Oct. 22, 1992

§ 102(e) Date: Oct. 22, 1992

[87] PCT Pub. No.: WO92/05353

PCT Pub. Date: Apr. 2, 1992

[30] Foreign Application Priority Data

Sep. 24, 1990 [DE] Fed. Rep. of Germany ... 9011832[U]

[51] Int. Cl.[5] ..... F02D 41/10; F02D 41/12

[52] U.S. Cl. ..... 123/492; 123/493

[58] Field of Search ..... 123/478, 480, 486, 488, 123/491, 492, 493

[56] References Cited

U.S. PATENT DOCUMENTS

| | | | |
|---|---|---|---|
| 4,359,993 | 11/1982 | Carlson | 123/478 |
| 4,534,331 | 8/1985 | van Belzen et al. | 123/492 |
| 4,636,957 | 1/1987 | Otobe et al. | 123/492 X |
| 4,643,152 | 2/1987 | Yamato | 123/492 X |
| 4,747,387 | 5/1988 | Takao et al. | 123/492 X |
| 4,901,699 | 2/1990 | Miwa et al. | 123/492 |
| 4,919,100 | 4/1990 | Nakamura | 123/492 |
| 4,962,742 | 10/1990 | Nishizawa et al. | 123/492 |
| 5,044,342 | 9/1991 | Yamane et al. | 123/492 |
| 5,101,795 | 4/1992 | Hirschmann et al. | 123/492 |
| 5,154,152 | 10/1992 | Yamane et al. | 123/492 |

FOREIGN PATENT DOCUMENTS

| | | |
|---|---|---|
| 0157340 | 10/1985 | European Pat. Off. . |
| 0241029 | 10/1987 | European Pat. Off. . |
| 60/156946 | 8/1985 | Japan . |
| 60/156947 | 8/1985 | Japan . |
| 60/156948 | 8/1985 | Japan . |

*Primary Examiner*—Willis R. Wolfe

*Attorney, Agent, or Firm*—Hill, Steadman & Simpson

[57] ABSTRACT

A correction factor K for the transition correction of the quantity of fuel to be injected on acceleration or deceleration depends upon a pressure change in the intake pipe Δp which lies in a characteristic field depending on the throttle valve position α and the rotation speed n.

8 Claims, 1 Drawing Sheet

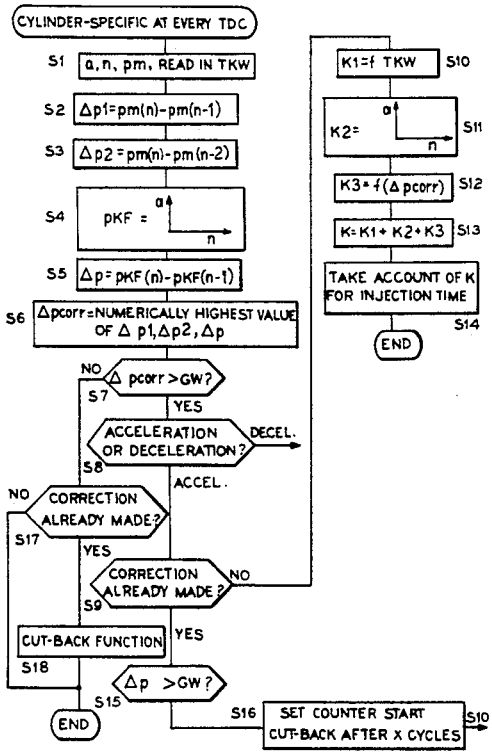

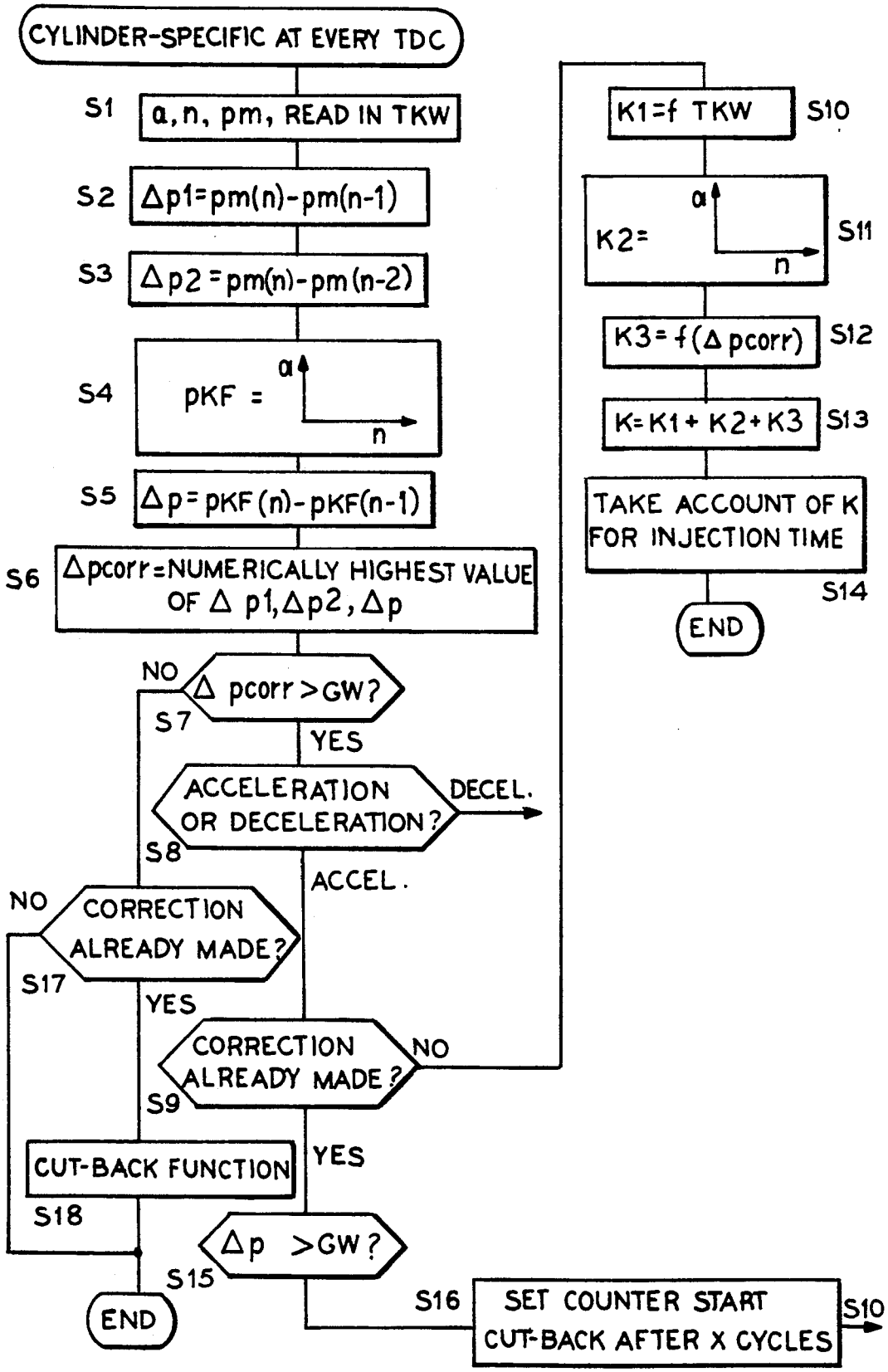
CYLINDER-SPECIFIC AT EVERY TDC
S1
α, n, pm, READ IN TKW
S2
Δp1=pm(n)-pm(n-1)
S3
Δp2=pm(n)-pm(n-2)
S4
pKF =
α
n
S5
Δp=pKF(n)-pKF(n-1)
S6
Δpcorr=NUMERICALLY HIGHEST VALUE OF Δ p1, Δp2, Δp
NO
Δ pcorr>GW?
S7
YES
ACCELERATION OR DECELERATION?
DECEL.
S8
ACCEL.
NO
CORRECTION ALREADY MADE?
S17
YES
CORRECTION ALREADY MADE?
NO
S9
CUT-BACK FUNCTION
YES
S18
Δp >GW?
S15
END
S16
SET COUNTER START CUT-BACK AFTER X CYCLES
S10
K1=f TKW
S10
K2=
α
n
S11
K3=f(Δ pcorr)
S12
K=K1+K2+K3
S13
TAKE ACCOUNT OF K FOR INJECTION TIME
S14
END

PROCESS FOR THE TRANSITION CORRECTION OF THE MIXTURE CONTROL OF AN INTERNAL COMBUSTION ENGINE DURING DYNAMIC TRANSITION STATES

BACKGROUND OF THE INVENTION

The invention concerns a transition correction of the mixture control of an internal combustion engine during dynamic transition states.

Such a process is, for example, described in U.S. Pat. No. 4,359,993.

In this, the throttle valve position, the rotational speed and the induction pipe pressure are recorded by means of appropriate sensors for acceleration enrichment or deceleration weakening. Taking account of the change to the throttle valve position is intended to ensure a rapid correction of the fuel quantity to be injected during transition. Additionally taking account of the change to the measured induction pipe pressure is intended, by means of a slower correction, to compensate for wall film effects.

SUMMARY OF THE INVENTION

The object of the present invention consists, in contrast, in taking even better account of changes to induction pipe pressure in the dynamic transition state so that it is possible to carry out a rapid correction corresponding to the change in induction pipe pressure.

The solution according to the invention is a process for the transition correction of the mixture control of an internal combustion engine during dynamic transition states. At least the throttle valve position, the rotational speed and the induction pipe pressure are recorded. For the transition correction, a correction factor influencing the fuel quantity to be injected is formed as a function of the measured induction pipe pressure or an induction pipe pressure change which has been determined. For the determination of the induction pipe pressure change, a characteristic field is used which contains induction pipe pressure values dependent on the throttle valve position and the rotational speed. The induction pipe pressure change is the numerically largest value of the difference values from the two last sequentially determined induction pipe pressure values and the difference between an induction pipe pressure value previously measured and the induction pipe pressure value last measured.

advantageous developments of the present invention are as follows.

A corrected induction pipe pressure change is the largest of three change values which have been determined. The first change value is the difference between the current induction pipe pressure and the last recorded measurement of induction pipe pressure. The second change value is the difference between the current induction pipe pressure and a second-last recorded induction pipe pressure. The third change value is the induction pipe pressure change determinedly by means of the characteristic field. The process is started when the corrected induction pipe pressure change exceeds a certain limiting value. The induction pipe pressure values in the characteristic field are selected in such a way that the resulting induction pipe pressure change during a constant acceleration or deceleration is always less than the first change value.

The processes for an acceleration enrichment and a deceleration weakening are carried out in the same way.

The transition correction is ended after x further calculations if the third change value drops below the limiting value and the first or second change value is still above the limiting value. The transition correction is ended if all three change values fall below the limiting value.

The correction factor also depends on the cooling water temperature.

The invention is based on the fact that the decisive parameters for injection quantity correction in transition are considered to be the induction pipe pressure and its changes. The problem arises because a change in the induction pipe pressure caused by the opening and closing of the throttle valve is only recorded by the associated induction pipe pressure sensor after a certain time lag. This time lag is caused by pressure transit times in the induction pipe and increases with increasing induction pipe length. This makes the necessary rapid transition correction impossible.

In accordance with the invention, therefore, it is not the induction pipe pressure measured by the induction pipe pressure sensor which is used for determining the change in induction pipe pressure but, rather, a characteristic field. This characteristic field depends on the throttle valve position and the rotational speed. By this means, it is possible to associate the correct induction pipe pressure with each throttle valve position,, taking account of the rotational speed, without transit time delays. The induction pipe pressure change is then given by the difference between two such sequential induction pipe pressure values. A rapid correction to the fuel quantity to be injected, during acceleration for example, can take place on the basis of the induction pipe pressure change determined in this way without the otherwise usual indirect process via the change to the throttle valve position.

In accordance with a particularly advantageous embodiment, a corrected induction pipe pressure change is calculated which also takes the measured induction pipe pressure into account. The corrected induction pipe pressure change is then the largest of three change values determined. The first of these change values is the difference between the current induction pipe pressure and the last recorded measurement of induction pipe pressure. The second change value is the difference between the current induction pipe pressure and the second-last recorded measurement of induction pipe pressure, which thus represents a smoothed induction pipe pressure change. The third change value, finally, is the induction pipe pressure change determined by means of the characteristic field.

Such a process has substantial advantages. On the one hand, the induction pipe pressure change determined by means of the characteristic field provides the possibility of rapid intervention. Because—as described above—it is not subject to time lag, it represents, at the beginning of an acceleration process, for example, the largest of the three change values and there is an immediate reaction to this change value. In this case, the corrected induction pipe pressure change is equal to the induction pipe pressure change determined by means of the characteristic field. The process for the transition correction is correspondingly started when the corrected induction pipe pressure change exceeds a certain limiting value.

In the case of an acceleration enrichment which is already taking place, on the other hand, the change values determined by means of the measured induction pipe pressure can be greater than the change value determined by means of the characteristic field. This is, for example, the case if the accelerator pedal is abruptly released during an acceleration and then depressed again. In this case, the second, smoothed change value is then the largest value because it gives the continuing acceleration tendency.

In accordance with another further development of the invention, it is only the possibility of rapid intervention which disappears in the case of faulty matching of the characteristic field, due to ageing or other influences. The values deposited in the characteristic field are applied in such a way that during a current constant acceleration, for example, the third change value determined by means of the characteristic field is always smaller than the first change value. This means that the third change value is always responsible for the dynamic state only, i.e. at the beginning of the acceleration, during acceleration changes and at the end of the acceleration. In the case of the faulty matching discussed at the beginning, therefore, only this rapid correction would disappear.

BRIEF DESCRIPTION OF THE DRAWING

The features of the present invention which are believed to be novel, are set forth with particularity in the appended claims. The invention, together with further objects and advantages, may best be understood by reference to the following description taken in conjunction with the accompanying drawing, and in which:

The FIGURE shows a flow diagram for the start and execution of an acceleration enrichment.

DESCRIPTION OF THE PREFERRED EMBODIMENT

The process for the transition correction of the mixture control is applied to a conventional electronically controlled fuel injection system. In normal driving, the fuel quantity to be injected is determined as a function of the load and the rotational speed of the internal combustion engine. During a dynamic transition state, i.e. during an acceleration or a deceleration, a correction factor K is calculated by means of which a correspondingly increased or reduced quantity of fuel to be injected is determined.

The transition correction function makes use of the signals of the following sensors, which are already provided in the injection system for other functions. These are a throttle valve position $\alpha$, a rotational speed n, a measured induction pipe pressure pm and a cooling water temperature TKW.

As shown in the flow diagram of the figure, these values are read in at each top dead center of a cylinder of the internal combustion engine in the step S1. The process is therefore carried out jointly with each injection time calculation.

In the steps S2 and S3, two change values of the induction pipe pressure are calculated on the basis of the measured induction pipe pressure pm. $\Delta$ p1 is the difference between the current and the last value and $\Delta$ p2 is the difference between the current and the second-last value.

A third change value $\Delta$ p is determined by the steps S4 and S5. During the step S4, an induction pipe pressure value pKF is taken from a characteristic field. This characteristic field is plotted in terms of the throttle valve position $\alpha$ and the rotational speed n. The induction pipe pressure values pKF are determined for each engine type by test drives or on the test stand. The induction pipe pressure change $\Delta$ p is the difference between the current induction pipe pressure pKF and the induction pipe pressure value pKF determined during the last cycle.

A corrected induction pipe pressure change $\Delta$ pcorr is determined during the step S6 and this is equal to the largest of the three change values from the steps S2, S3 and S5. At the beginning and at the end of an acceleration or deceleration, this largest value will be the induction pipe pressure change $\Delta$ p because it is taken directly, without time delay, from the characteristic field as a function of the throttle valve position a and the rotational speed n and is not determined by means of the measured induction pipe pressure pm, which is subject to the transit time.

The characteristic field values are applied in such a way that the change value $\Delta$ p1 is larger during a constant acceleration or deceleration which is already taking place. The induction pipe pressure change $\Delta$ p determined from the characteristic field only comes into effect, therefore, in the case of rapid changes; otherwise, the change values determined from the measured induction pipe pressure PM are the determining factor. The change value $\Delta$ p2 is used to widen the range of the pressure change values.

In the step S7, the corrected induction pipe pressure change $\Delta$ pcorr determined during step S6 is compared with a limiting value GW. If it is greater than the limiting value GW, either an acceleration or a deceleration is present. If, on the other hand, it remains below the limiting value GW, there is no need to carry out a transition correction and the process is interrupted if the transition correction is not already taking place. This case is discussed later.

The step S8 decides whether an acceleration or a deceleration is present. This corresponds to an evaluation of the sign of the determined induction pipe pressure change $\Delta$ p from the step S5 and depends on whether the induction pipe pressure is increasing or decreasing.

In what follows, the case of an acceleration is considered. The procedure in the case of a deceleration is analogous, the only difference being that the correction factors subsequently calculated are then selected in terms of a reduction of the fuel quantity to be injected.

If, therefore, an acceleration is recognized, the step S9 takes place and checks whether a correction has already been effected once. If this is the case, the conditions for ending the acceleration correction must then be interrogated, as is described later in association with the figure.

In the case of an acceleration condition being recognized for the first time, on the other hand, the steps S10 to S14 take place to determine a correction factor K which corrects the fuel quantity to be injected. The correction factor K consists of three parts K1 to K3. The first part K1 depends on the cooling water temperature TKW and therefore takes account of the different fuel quantities required for a cold engine or a hot engine. The second part K2 is taken from a characteristic field as a function of the throttle valve position $\alpha$ and the rotational speed n. The load on the engine is taken into account by means of this characteristic field. The third part K3, finally, depends on the corrected induction pipe pressure change Δ pcorr and takes the dynamic procedures into account. The corresponding values and functions for the steps S10, S11 and S12 are again determined by test drives or on the engine test stand.

The correction factor K is determined during the step S13 from the sum of the three parts K1 to K3. During the step S14, finally, this correction factor K is passed on to the procedural routine for injection time calculation, which then specifies a correspondingly longer injection period and, therefore, a larger fuel quantity.

The correction factor K for acceleration enrichment is recalculated in accordance with the steps previously described each time the top dead center of a cylinder is reached. From first recognition of the acceleration state, the interrogation for ending the acceleration enrichment then takes place during the next cycle at the step S9.

For this purpose, the step S15 checks whether the induction pipe pressure change Δ p determined by means of the characteristic field is greater than the limiting value GW. If this is the case, the steps S10 to S14 for calculating the new correction factor K again take place. If, however, the induction pipe pressure change Δ p is smaller than the limiting value GW, one of the change values Δ p1 or Δ p2 must still be greater than the limiting value GW because otherwise, the process would have been ended at the step S7. In this case, therefore, the reduction of the induction pipe pressure change Δ p to a value below the limiting value GW is already indicating the interruption of the acceleration state and, in consequence, the process is ended after a permitted application number of x times, despite the fact that a change value p1 or p2 is still above the limiting value GW. For this purpose, a counter is started at the step S16 which permits a further x cycles of the steps S10 to S14 and then calls up a cut-back function for the acceleration enrichment.

The process is also ended if—as already mentioned—the answer at the step S7 is no. In this case, none of the three change values still exceeds the limiting value GW- Because the correction is already proceeding, the answer at the step S17 is yes and the step S18, with the cut-back function, follows. This returns the fuel quantity to be injected, which has been increased by the correction factor K, to the normal load-dependent/speed-dependent value in accordance with a function which can be preselected.

The invention is not limited to the particular details of the method depicted and other modifications and applications are contemplated. Certain other changes may be made in the above described method without departing from the true spirit and scope of the invention herein involved. It is intended, therefore, that the subject matter in the above depiction shall be interpreted as illustrative and not in a limiting sense.

What is claimed is:

1. A method for transition correction of a mixture control of an internal combustion engine during dynamic transition states, comprising the steps of:

recording at least a throttle valve position, a rotational speed and an induction pipe pressure of the internal combustion engine;

forming, for the transition correction, a correction factor influencing the fuel quantity to be injected as a function of at least one of a measured induction pipe pressure or an induction pipe pressure change which has been determined;

using, for the determination of the induction pipe pressure change, a characteristic field which contains induction pipe pressure values dependent on the throttle valve position and the rotational speed and the induction pipe pressure change being the numerically largest value of the difference values from the two last sequentially determined induction pipe pressure values and the difference between an induction pipe pressure value previously measured and the induction pipe pressure value last measured.

2. The method as claimed in claim 1, wherein the correction factor also depends on the cooling water temperature.

3. The method as claimed in claim 1, wherein a corrected induction pipe pressure change is the largest of three change values which have been determined, where the first change value is the difference between the current induction pipe pressure and the last recorded measurement of induction pipe pressure, the second change value is the difference between the current induction pipe pressure and a second-last recorded induction pipe pressure and the third change value is the induction pipe pressure change determined by means of the characteristic field.

4. The method as claimed in claim 3, wherein the process for an acceleration enrichment and a deceleration weakening are carried out in the same way.

5. The method as claimed in claim 3, wherein the method is started when the corrected induction pipe pressure change exceeds a certain limiting value.

6. The method as claimed in claim 5, wherein the induction pipe pressure values in the characteristic field are selected in such a way that the resulting induction pipe pressure change during a constant acceleration or deceleration is always less than the first change value.

7. The method as claimed in claim 5, wherein the transition correction is ended after x further calculations, where x is a whole number, if the third change value drops below the limiting value and the first or second change value is still above the limiting value.

8. The method as claimed in claim 7, wherein the transition correction is ended if all three change values fall below the limiting value.

* * * * *